United States Patent [19]

Krakow

[11] 3,991,597

[45] Nov. 16, 1976

[54] METHOD AND DEVICE FOR ADJUSTING FORMING ROLLS IN A HELICAL SEAM PIPE MILL

[75] Inventor: Heinz Krakow, Hamburg, Germany

[73] Assignee: Blohm & Voss AG, Hamburg-Steinwerder, Germany

[22] Filed: Dec. 10, 1974

[21] Appl. No.: 531,440

[30] Foreign Application Priority Data

Dec. 13, 1973 Germany ..... 2361992

[52] U.S. Cl. ..... 72/12; 72/49; 72/135; 228/145

[51] Int. Cl.[2] ..... B21B 37/04; B21B 37/08

[58] Field of Search ..... 72/12, 21, 49, 50, 133, 72/135; 29/477.3, 477.7

[56] References Cited

UNITED STATES PATENTS

| | | | |
|---|---|---|---|
| 3,146,331 | 8/1964 | Schubert | 72/135 |
| 3,776,010 | 12/1973 | Krakow | 72/12 |
| 3,845,645 | 11/1974 | Gebauer | 72/12 |

FOREIGN PATENTS OR APPLICATIONS

| | | |
|---|---|---|
| 1,075,530 | 10/1958 | Germany |

*Primary Examiner*—Leon Gilden
*Attorney, Agent, or Firm*—Toren, McGeady and Stanger

[57] ABSTRACT

In forming a metal plate or the like into a helical seam pipe, the plate is deformed by bending rolls each made up of individual forming rolls. The forming rolls are exposed to shearing forces if the plate varies its direction of travel toward the forming rolls. To prevent the continued presence of shearing forces, the forming rolls are pivotally mounted on a support which is displaceably guided within a holder and an adjusting mechanism is connected to the support and the forming rolls to adjust the setting angle of the forming rolls in accordance with the direction of travel of the plate toward the forming rolls.

4 Claims, 2 Drawing Figures

METHOD AND DEVICE FOR ADJUSTING FORMING ROLLS IN A HELICAL SEAM PIPE MILL

SUMMARY OF THE INVENTION

The present invention is directed to a mill for making helical seam pipes and, more particularly, it is directed to a method and a device for adjusting the setting angle of the individual forming rolls within a bending roll in the mill. To provide the necessary adjustment the individual forming rolls are pivotally mounted on a support which is displaceable within a guide in the direction of the axis of the pipe being formed.

In deforming plates which have an elastic limit of over 50 kg/gmm, a thickness of 30mm and which are frequently more than 4 m in width and about 20 m in length, considerable surface pressure is required to deform such material into a helical seam pipe. The pressure required can far exceed 1000 t.

The forming rolls in a helical seam pipe mill are set, as is known, to correspond to the pitch of the helical seam. However, it has been found in practice that it is not possible even with the greatest care to adjust the setting angle of the forming rolls exactly to the theoretically correct angle with regard to the longitudinal direction of the pipe axis. Even slight angular deviations lead to shearing forces acting on the forming rolls in the direction of the axis of the pipe which lead in the course of the formation of the pipe to the destruction of the forming rolls or their bearings. According to the surface pressure and the friction coefficient between the forming roll and its journal, these shearing forces can amount to several hundred tons, which not only impairs a satisfactory deformation but also unduly stresses the construction of the forming station, so that a premature failure of the forming rolls is unavoidable. The present invention is directed to the problem of avoiding such premature failure.

In accordance with the present invention, the problem previously experienced is solved by correcting the setting angle of the forming rolls during the formation of the helical seam pipe based on the shearing forces acting on the forming rolls. By the shearing forces is meant, as far as it is not already clear from the foregoing considerations, the forces acting on the forming rolls and other components at the forming station resulting from the surface pressures and direction of travel of the plate or band forming the pipe relative to the direction of rotation of the forming rolls, with the shear forces acting in the direction of the pipe axis being formed and at a right angle to the roll plane. With this arrangement a satisfactory deformation of the band or plate into the helical seam pipe is insured even when large plate thicknesses and high plate qualities are involved. Further, the forming station is protected against failure or destruction, especially when, according to another feature of the invention, the shearing forces cause a longitudinal displacement of the roll support for the forming rolls in the direction of the axis of the pipe being formed. Preferably, the forming roll support slides within a guide in a holder and its sliding movement is used to generate a switching signal for correcting the setting angle of the forming rolls.

The helical seam pipe mill as referred to herein is preferably a mill which has a so-called three-roll bending system. Since in such a forming system the inner roll support, or the inner bending roll, is stressed with twice the deformation pressure as the outer bending rolls, the shearing forces have a greater damaging effect on the inner bending roll and, more particularly, to its individual forming rolls.

Therefore, in accordance with the invention, the correction of the setting angle can be provided only for the inner bending roll. However, it is also possible to design all three of the bending rolls or roll supports with a sliding bearing arrangement in accordance with the present invention.

The device constructed in accordance with the present invention includes a roll support which is displaced in the direction of the axis of the pipe being formed and in the course of its displacement it actuates an adjusting mechanism, which may be either mechanically, electrically or hydraulically operated, to correct the setting angle of the individual forming rolls mounted on the roll support.

In a preferred embodiment of the device, the roll support on which the forming rolls are pivotally mounted, is slidably positionable within a guide in a holder and, during the sliding movement closed by shearing forces, actuates an adjusting gear which operates the adjusting mechanism for correcting the setting angle of the forming rolls.

To actuate the adjusting gear a trip cam is mounted on the slidably displaceable roll support and moves between a pair of spaced switching contacts which actuate the adjusting gear. Another characteristic of the invention is that the adjusting mechanism includes an adjusting bar connected to the adjusting gear and when the adjusting gear is actuated and displaces the bar, it causes a number of guide rods or plates, connected to spaced journals on the bar, to pivot members supporting the forming rolls so that each of the rolls is placed in the corrected setting angle.

In another embodiment of the invention, it is possible for the shearing forces to release, by means of piezoelectric elements, current impulses which control a drive for the adjusting gear for varying the setting angle. The piezoelectric elements can be arranged between the bending roll or roll support, on the one hand, and the frame of the forming station or the roll support holder, on the other hand, so that the piezoelectric elements are pressed in compression by the shearing forces, preferably in one or the other directions of the axis of the pipe being formed.

In a mechanical adjusting device, the translatory movement of the roll support caused by the shearing forces can be transformed by means of a fixed point on the holder into a rotary movement for adjusting the setting angle of the forming rolls.

Finally, a device according to the invention can be provided only on the inner bending roll which can transmit the adjustment values or energies established as impulses to the adjusting motors of the outer bending rolls.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
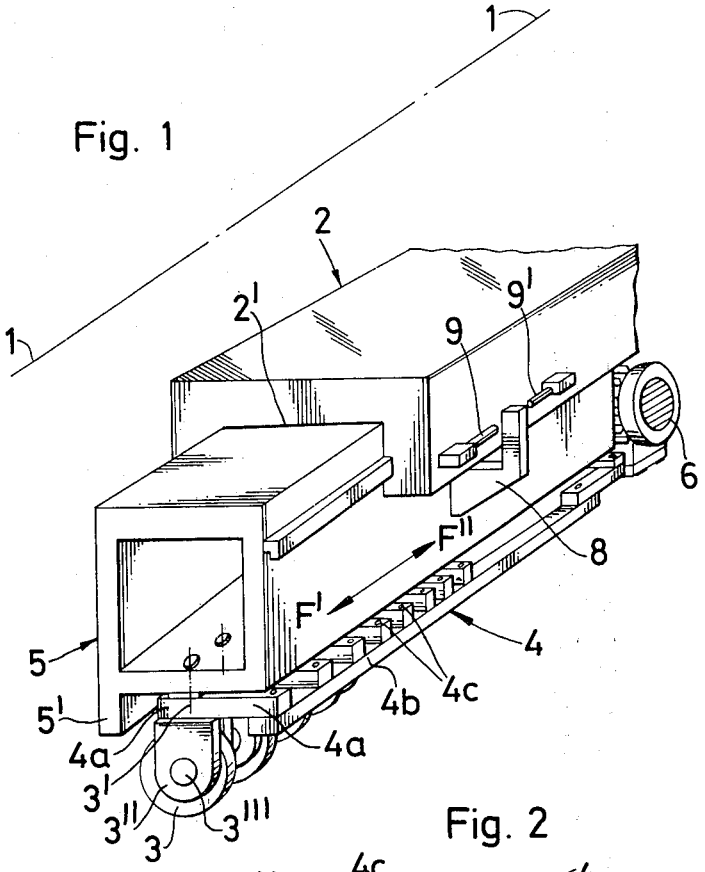
FIG. 1 is a perspective view of a bending roll formed in accordance with the present invention.
Figure 2:
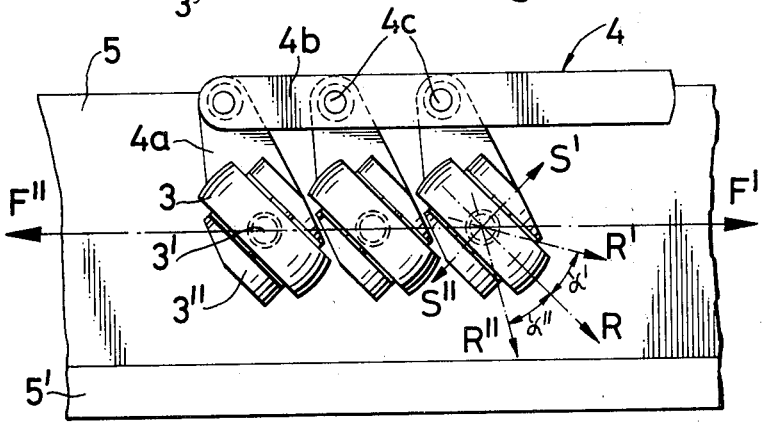
FIG. 2 is an enlarged bottom view of the bending roll shown in FIG. 1 illustrating schematically the manner in which the forming rolls are adjusted.

In FIG. 1, the bending roll comprises a holder 2 extending substantially parallel to the axis 1 of the pipe being formed. A guide 2' is formed within the holder 2 and a roll support 5 (inner bending roll) is mounted within the guide for sliding or rolling movement in the direction of the pipe axis 1, note the direction of movement indicated by the arrows F', F''. As illustrated, the roll support 5 is a box-shaped member having a square cross section with an extension 5' extending downwardly from one side. A plurality of forming rolls 3 are dependently supported from the roll support 5 so that they can be turned about an axis 3' in the roll support which extends generally perpendicular to the pipe axis 1. The axes or axles 3' each support a fork 3'' in which a shaft 3''' is provided for rotatably mounting the forming rolls 3.

The position of the individual forming rolls depending from the roll support 5 can be moved by an adjusting device 4 to establish the desired setting angle. The adjusting device 4 consists of an adjusting gear 6 secured to one end of the support 5 and connected to an adjusting bar **4*b* which extends in the longitudinal direction of the support 5, that is, in the direction of the pipe axis 1. The adjusting gear 6 is rigidly secured to the support 5 which can be slid or rolled within the guide 2' of the holder 2. A plurality of journals 4*c* are located in spaced positions along the adjusting bar 4*b* for articulating the bar to a corresponding number of guide rods or plates 4*a* which extend laterally from the bar and are integrally secured to the forks 3''**.

As illustrated schematically by the arrows R, R' and R'', the band or plate, not shown, to be formed into the helical seam pipe can enter the forming station over an angular range relative to the individual forming rolls 3. When the band moves along a path of travel as represented by the arrow R, there is no shearing force developed, however, if the band is displaced into the path of travel represented by either of the arrows R' or R'', then a corresponding shearing force S' or S'' acts on the forming rolls and causes the roll support 5 to slide within the guide of the holder 2 in the direction of the arrows R, R' and R'', respectively. In other words, when the band moves in the direction R, there is no displacement of the roll support, however, if the direction of the path of travel of the band changes as indicated by the directions R' or R'' then the roll support will be displaced by the shearing forces generated and will move in either the direction F' or F''.

Extending laterally from the side of the roll support 5 is a trip cam 8 which is positioned for movement between a pair of switching contacts 9, 9' mounted on the holder 2. The switching contacts are connected to the adjusting gear 6. If the roll support is displaced in either of the directions F' or F'' it will move into contact with one of the switching contacts 9, 9' and cause the adjusting gear 6 to displace the forming rolls 3 over the adjusting bar **4*b* which by means of its journals 4*c* pivots the guide plates 4*a* about the axles 3*a* changing the setting angle of the forming rolls. As a result, the range of setting angles represented by the angles $\alpha'$ and $\alpha''$ adjust to the direction of the paths of travel of the band being deformed into the helical seam pipe and counteracts the development of the shearing forces on the forming rolls. During the continued formation of the helical seam pipe, as any shearing forces developed displace the roll support 5, the trip cam 8 actuates the adjusting gear 6 over either of the switching contacts 9, 9'** to provide the necessary correction of the setting angle. As a result, the shearing forces which could cause damage or destruction of the forming rolls, no longer act.

While a specific embodiment of the invention has been shown and described in detail to illustrate the application of the inventive principles, it will be understood that the invention may be embodied otherwise without departing from such principles.

What is claim is:

1. Method of adjusting the setting angle of the direction of rotation of pivotally mounted individual forming rolls of a bending roll in a helical seam pipe mill in which a metal plate or band is deformed by the bending roll to form the helical seam pipe, comprising the steps of supporting the individual forming rolls as a unit for displacement in the axial direction of the helical pipe being formed and positioning the forming rolls relative to the direction of travel of the metal plate toward the forming rolls, sensing the displacement of the unit of forming rolls in the axial direction of the helical pipe being formed resulting from the effect of shearing forces acting on the rolls as a result of a change in direction of the travel of the metal plate, and adjusting the setting angle in accordance with the extent of the displacement of the unit of the forming rolls in the axial direction of the helical pipe being formed so that the presence of the sheering forces acting on the forming rolls is avoided.

2. Device for adjusting the setting angle of the direction of rotation of individual forming rolls of a bending roll in a helical seam pipe mill relative to a metal plate or band which is fed to and is deformed by the forming rolls to form the helical seam pipe which pipe has a central axis and the metal plate is fed along a path of travel disposed at an oblique angle to the central axis of the helical seam pipe, comprising a forming roll support, a plurality of forming rolls disposed in laterally spaced relation in the direction of the central axis of the helical seam pipe and arranged in side-by-side relation and adjustably positionably mounted on said forming roll support for adjustment relative to any displacement in the direction of the path of travel of the metal plate fed to said forming rolls as experienced by shearing forces developed in said forming rolls by contact with the metal plate, means for movably supporting said forming roll support so that it is displaceable in the direction of the central axis of the helical pipe being formed, and means associated with said forming roll support and with said means for movably supporting said forming roll support and connected to said forming rolls for adjusting the setting angle of the forming rolls in response to any shearing forces developed in the forming rolls as a result of a change in the direction of travel of the metal plate being fed to the forming rolls and by adjusting the setting angle avoiding the presence of shearing forces acting on said forming rolls due to changes in the direction of the path of travel of the metal plate being fed into contact with the forming rolls, said means for movably supporting said forming roll support comprises a support holder having a guide formed therein and extending in parallel relation with the central axis of the helical seam pipe being formed, and said forming roll support being mounted in said guide of said support holder for movement parallel to the direction of the central axis of the helical seam pipe being formed, said means for adjusting the setting angle comprises an adjusting mechanism secured to said forming roll support, said forming rolls individually supported on said forming roll support and connected to said adjusting mechanism, an adjusting gear mounted on said forming roll support and connected to said adjusting mechanism, and said adjusting mechanism arranged to be displaced by said adjusting gear and to position each of said forming rolls at the same setting angle.

3. Device, as set forth in claim 2, wherein said adjusting mechanism comprises a plurality of axles spaced apart in the direction of the central axis of the helical seam pipe being formed and the axles being disposed in parallel relation and supported from said support holder, the axes of said axles extending transversely of the direction of the axis of the helical seam pipe being formed, a fork attached to each said axle for pivoting relative to the axis thereof, a shaft positioned in each of said forks extending transversely of the direction of the axle supporting said fork, one said forming roll rotatively mounted on said shaft in each said fork for rotation about the axis of said shaft, a guide plate attached to each of said forks, a longitudinally extending adjusting bar connected to said adjusting gear, said adjusting bar extending in its longitudinal direction in generally parallel relation with the direction of the axis of the helical pipe being formed, a plurality of spaced journals positioned on said adjusting bar and spaced apart in the longitudinal direction of said adjusting bar with each of said guide plates being connected to a different one of said journals so that as said adjusting bar is displaced in its longitudinal direction by said adjusting gear said guide plates are pivoted by their connection to said journals and, in turn, pivot said forks about the axis of the axles on which they are mounted so that forming rolls mounted in said forks pivot about the axis of said axles.

4. Device for adjusting the setting angle of the direction of rotation of individual forming rolls of a bending roll in a helical seam pipe mill in which a metal plate or band is deformed by the forming rolls to form the helical seam pipe, comprising a forming roll support, a plurality of forming rolls disposed in side-by-side relation and adjustably positionably mounted on said forming roll support, means for movably supporting said forming roll support so that it is displaceable in the direction of the axis of the helical pipe being formed, means associated with said forming roll support and said means for movably supporting said forming roll support and connected to said forming rolls for adjusting the setting angle of the forming rolls to avoid the presence of shearing forces acting on said forming rolls caused by changes in the direction of the path of travel of the metal plate moving into contact with the forming rolls, said means for movably supporting said forming rolls support comprises a support holder having a guide formed therein and extending in parallel with the direction of the axis of the helical seam pipe being formed, said forming roll support being movably mounted in said guide of said support holder, said means for adjusting the setting angle comprises an adjusting mechanism secured to said forming roll support, said forming rolls individually supported on said forming roll support and connected to said adjusting mechanism, an adjusting gear mounted on said forming roll support and connected to said adjusting mechanism, said adjusting mechanism arranged to be displaced by said adjusting gear and to position each of said forming rolls at the same setting angle, said adjusting mechanism comprises a plurality of axles spaced apart in parallel relation and supported from said support holder, the axes of said axles extending transversely of the direction of the axis of the helical seam pipe being formed, a fork attached to each said axle for pivoting relative to the axis thereof, a shaft positioned in each of said forks extending transversely of the direction of the axle supporting said fork, one said forming roll rotatably mounted on said shaft in each said fork for rotation about the axis of said shaft, a guide plate attached to each of said forks, a longitudinally extending adjusting bar connected to said adjusting gear, said adjusting bar extending in its longitudinal direction in generally parallel relation with the direction of the axis of the helical seam pipe being formed, a plurality of spaced journals positioned on said adjusting bar and spaced apart of the longitudinal direction of said adjusting bar with each of said guide plates being connected to a different one of said journals so that as said adjusting bar is displaced in its longitudinal direction by said adjusting gear said guide plates are pivoted by their connection to said journals and, in turn, pivot said forks about the axis of the axles on which they are mounted so that forming rolls mounted in said forks pivot about the axis of said axles, and said means for adjusting the setting angle further comprises a trip cam secured to said forming roll support for movement with said forming roll support when it is displaced due to shearing forces acting on said forming rolls, a pair of switching contacts secured to said support holder and spaced apart in the direction of movement of said forming roll support within said guide in said support holder, said trip cam located between said switching contact so that it engages said switching contacts as said forming roll support is displaced in the direction of the axis of the helical seam pipe being formed, said switching contact disclosed in communication with said adjusting gear for operating said adjusting gear in opposite directions when contacted by said trip cam for adjusting the setting angle of said forming rolls over said adjusting bar.

* * * * *